US005253859A

United States Patent [19]

Ricciardi

[11] Patent Number: 5,253,859

[45] Date of Patent: Oct. 19, 1993

[54] APPARATUS AND METHOD FOR STACKING SHEET-LIKE ARTICLES

[76] Inventor: Mario Ricciardi, 2816 Virginia La., Glenview, Ill. 60025

[21] Appl. No.: 712,195

[22] Filed: Jun. 7, 1991

[51] Int. Cl.[5] ..... B65H 43/00

[52] U.S. Cl. ..... 271/176; 271/179; 271/180; 271/215; 271/201

[58] Field of Search ..... 271/177, 178, 179, 180, 271/184, 199, 200, 201, 214, 215, 176

[56] References Cited

U.S. PATENT DOCUMENTS

| | | | |
|---|---|---|---|
| 3,160,293 | 12/1964 | Hennequin | 271/179 |
| 3,445,107 | 5/1969 | Stoothoff | 271/177 |
| 3,469,836 | 9/1969 | Javid | 271/199 |
| 3,682,473 | 8/1972 | Ruyt | 271/201 |
| 4,509,739 | 4/1985 | Kurokawa | 271/179 |
| 4,955,596 | 9/1990 | Riccaridi . | |

FOREIGN PATENT DOCUMENTS

| | | | |
|---|---|---|---|
| 0102731 | 6/1984 | Japan | 271/178 |

*Primary Examiner*—H. Grant Skaggs
*Attorney, Agent, or Firm*—Welsh & Katz, Ltd.

[57] ABSTRACT

An apparatus and method for stacking a plurality of flat articles on edge, comprising a discharge magazine for sequentially receiving and stacking the flat articles in a stack, the discharge magazine including moveable discharge support belts adapted to support the stack of articles on edge and a moveable compression plate to maintain the articles on edge. A drive element is provided for controllably moving the discharge support belts. A stacker section adjacent the discharge magazine transports articles sequentially into the stack, the stacker section comprising stacker belts extending around a plurality of rollers.

The last of the articles in the stack abuts against the stacker belts adjacent one of the rollers to apply a compressive force developed by the stack of flat articles and the compression plate to the one roller. The one roller is movably mounted to the apparatus for movement responsive to increases and decreases in the compressive force. An actuator element is operatively connected to and responsive to movement of the one roller and connected to the drive element for activating the drive element and the discharge support belts to transport the stack of flat articles away from the stacker section when the compressive force reaches a predetermined maximum value.

14 Claims, 4 Drawing Sheets

APPARATUS AND METHOD FOR STACKING SHEET-LIKE ARTICLES

FIELD OF INVENTION

The present invention relates generally to an apparatus and method for stacking sheet-like articles, and more particularly to a device for controlling the pressure in a stack when stacking sheet-like articles such as envelopes that are continuously being fed into the stack.

BACKGROUND OF THE INVENTION

Envelope processing systems, such as mail piece processing, sorting and bar code application systems, typically include an envelope stacking apparatus at the end of the system to secure the sorted mail pieces in a stacked position to facilitate orderly removal of the processed mail pieces from the system. The stacked mail pieces are manually or automatically removed from the stack and/or bound by an operator.

One such stacking apparatus is disclosed in U.S. Pat. No. 4,955,596, commonly assigned. An envelope to be stacked, or any suitable sheet-like article, is forcibly fed on edge into a discharge magazine where it is stacked in a somewhat compressed array with other, previously fed envelopes. The envelope enters the discharge magazine via a dual stacker belt transport configuration, wherein a pair vertically juxtaposed stacker belts rotate about rollers disposed in a triangular array. The rollers each are rotatably mounted on shafts having a fixed axis.

The discharge magazine includes multiple transport belts that may have smooth surfaces, or may have track-like protrusions extending above the discharge magazine floor to engage the bottom edges of the stacked envelopes and advance the envelopes away from the stacker belts to permit the free entry of additional envelopes into the stacker region. The transport belts are activated by a stack sensor mechanism that includes a spring biased, pivotally mounted lever arm which extends through a gap between the pair of stacker belts. The tip of the lever arm contacts the last envelope to enter the stack. As the stack gets larger and the laterally applied normal force of the stacked envelopes overcomes the bias of the lever arm spring of the sensor mechanism, the lever arm trips a switch that in turn activates a drive motor connected to the transport belts to move the envelopes away from the stacker belts. This reduces the normal force or pressure exerted by the stack of envelopes on the stacker belts, and provides space for the entry of subsequent envelopes into the stack.

Although the stack sensor lever arm in the prior art apparatus contacts the last envelope in the stack, the lever arm contacts the last stacked envelope over a small plane, or sometimes a point, and is therefore highly susceptible to planar and height variations associated with the last stacked envelope. In high speed mail processing systems, a problem arises when the last envelope in the stack tilts such that the bottom edge and the top edge of the envelope no longer form a substantially vertical plane. As the stack becomes increasingly tight, accurate pressure sensing is critical to avoid jamming. Jamming occurs as a consequence of erroneous stack pressure sensing, when a tilted edge of the last stacked envelope obstructs the entrance to the stack of the next envelope to be stacked. Such problems are compounded when the stacker is used for simultaneously stacking a plurality of different sized (varying in height and thickness) envelopes.

Erroneous stack pressure sensing typically occurs where the lever arm contacts the tilted envelope at a surface or point that is tilted furthest away from the stacker belts. This surface exerts less force on the lever arm than the surface closest to the stacker belt. The lever arm's small plane or point of contact may erroneously indicate that the stack can receive more envelopes when the stack is actually too tight to properly receive another envelope without first activating the transport belts.

In view of the foregoing, an object of the present invention is to provide a high speed stacking apparatus and method that accurately senses the stack pressure of tilted articles to substantially reduce the occurrence of article jamming.

Another object of the present invention is to provide an apparatus and method that automatically and accurately senses the pressure applied by a stacked group of processed envelopes on a stacker conveying mechanism regardless of the degree of tilt of the last envelope to enter the stack, and in response thereto generates a signal to actuate an envelope transport system for advancing the documents in the stack away from the stacker conveyor means, thereby relieving the pressure on the conveying mechanism and creating space for the facile entry of additional processed envelopes into the stack.

A further object of the present invention is the provision of a sensor apparatus for a conveying belt mechanism for an envelope stacker device whereby one of the roller elements supporting the belt mechanism is on a laterally displaceable axis, whereby the axial displacement of the roller element is responsive to the force applied to the sensor apparatus by the stack of envelopes regardless of the angle of vertical orientation of the envelopes in the stack as the envelopes engage the sensor apparatus.

Yet another object of the present invention is the provision of an automatically actuated kicker mechanism that senses the trailing edge of an envelope entering the stack, and kicks the trailing edge away from the conveyor belts and onto an auger which drives the envelope's tracking edge outward to cooperate with the stack pressure sensor and control device to ensure that space is provided in the stack to permit subsequent envelopes to be fed into the stack without jamming.

SUMMARY OF THE INVENTION

The above objects and advantages are provided by the apparatus and method for stacking sheet-like articles disclosed herein. The invention includes an envelope conveying apparatus for stacking a series of sequentially fed sheet-like envelopes. The apparatus includes an elastic stacker belt assembly, one element of which comprises a movable roller element forming part of the conveying means, such as a spring biased roller, for sensing a force exerted by the stack of articles on the envelope conveying apparatus.

One embodiment of the invention comprises an envelope conveying apparatus having a dual belt system which extends around a portion of the moveable sensing roller and feeds the envelopes directly and sequentially into the stack. The moveable sensing roller also varies the tension of the conveying belts as a function of the force exerted by the stack of articles on the stacker belt system.

This embodiment of the invention includes a moveable dual belt system supported by a plurality of rollers, which belt system comprises the means for conveying envelopes into a stack of previously fed envelopes. One of the rollers is located adjacent the stack of envelopes, whereby the portion of the conveyor belt system passing over that particular roller is in contact with the stack of envelopes, and specifically in direct contact with the most recent envelope added to the stack. This one roller is rotatably supported on an axially moveable shaft disposed, in one embodiment, at one end of a lever arm, which lever arm is pivotally mounted to the base of the stacking mechanism. The other end of the lever arm, which is beyond the pivotal mounting point, includes means for biasing the lever arm such that the roller on the opposite end of the lever arm is urged toward the stack of envelopes. The belt portion extending around the axially moveable roller is biased to pivot into contact with the stack of articles with a force that counteracts the ever increasing force applied by the stack against the envelope conveying belt system. The force of the stack moves the axially moveable roller, which then acts as a sensing means to detect when the stack force or pressure reaches a predetermined maximum value. When this value is reached, the movement of the roller activates a motor operated drive mechanism which causes a horizontally disposed belt transport system upon which the stack of envelopes is supported to move the stack of envelopes away from, and relieve the pressure upon, the belt system of the envelope conveying means.

Another embodiment includes an envelope conveying system having a roller moveable in a substantially linear direction and a biasing element, such as a spring, operably coupled to the roller support structure for counteracting the force exerted by the stack of articles on the belt system of the envelope conveying means.

Another aspect of the present invention provides a kicker arm assembly which senses the trailing edge of an envelope entering the stacker region adjacent the envelope conveyor belt system, and applies a force to kick the trailing edge of each envelope away from the belt system and onto an auger to provide additional force to move the trailing edge of each document entering the stack out of the path of the leading edge of each subsequently fed envelope.

The method of the present invention for stacking sheet-like articles on edge of the present invention includes: conveying the individual documents into a stack of documents; sensing the force exerted by the stack of documents on a stacker infeed belt regardless of the angular disposition of the last documents added to the stack, and reducing the force exerted by the stack of documents on the stacker belts in response to the sensing of the force by moving the stack of documents in a direction away from the stacker belt system.

BRIEF DESCRIPTIONS OF THE DRAWINGS

DETAILED DESCRIPTION OF THE PREFERRED EMBODIMENT

Figure 1:
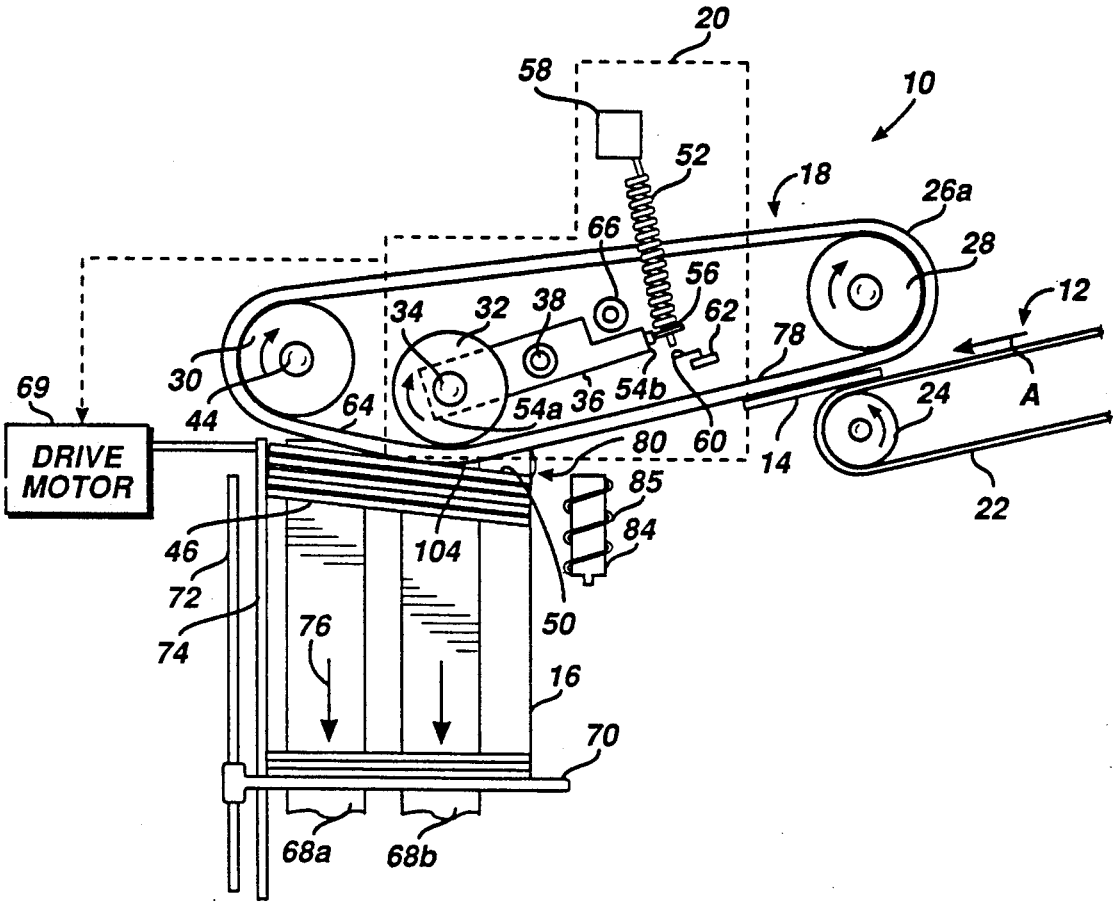
FIG. 1 is a top view schematically depicting a stacking apparatus constructed in accordance with the present invention, with the envelope kicker mechanism not shown.

FIG. 1 generally illustrates the preferred embodiment of the stacking apparatus 10 of the present invention having an introductory conveying path 12 for a document such as an envelope 14, a controllable discharge or document transport magazine 16, a stacking belt assembly 18, and a movable roller sensing mechanism 20. The introductory document conveying path 12 includes a feed belt 22 rotatable about a plurality of rollers 24 which drive belt 22 in the direction shown by arrow A. The path 12 may accept envelopes from a prior envelope feeding stage or other envelope processing stage. The feed belt 22 drives the envelope into contact with the stacking belt assembly 18 by virtue of the spatial proximity of the two belt assemblies. Alternately, feed belts 22 may comprise a pair of vertically separated 0-rings extended over pulleys used in place of rollers 24. The 0-rings are adapted to provide the same function as belts 22, which is to advance an envelope into contact with stacking belt assembly 18, as will be explained.

Figure 2:
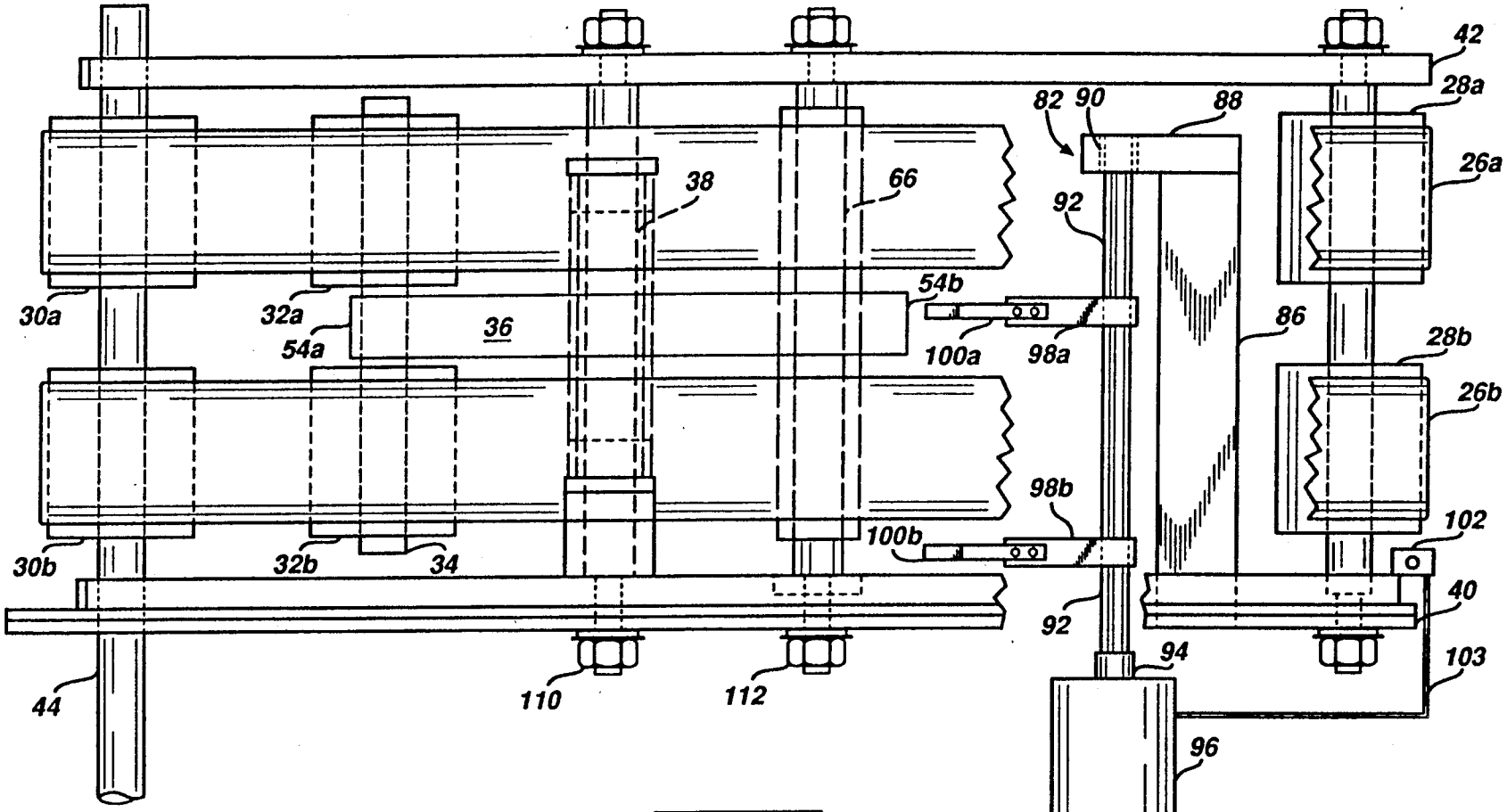
FIG. 2 is a front elevation view of the stacker belts and kicker mechanism forming the document drive of the present invention, with a portion of the stacker belts and rollers cut away to illustrate the kicker mechanism.

As seen in FIGS. 1 and 2, the stacker belt assembly 18 comprises a pair of elastic stacker belts **26*a* and 26*b* rotatable about axially fixed dual idler rollers 28*a* and 28*b*, axially fixed drive rollers 30*a* and 30*b*, and axially movable dual rollers 32*a* and 32*b*. Moveable roller 32 is rotatably mounted on a shaft 34 which shaft is mounted on a pivotally mounted lever arm 36. Lever arm 36 is rotatably mounted on a shaft 38, which in turn is fixed to a base plate 40 and a top plate 42 (FIG. 2) which form part of the static support assembly for the stacking apparatus 10**.

The stacker belts **26*a* and 26*b* extend about a triangular course of travel formed by the rollers 28*a*, 28*b*, 30*a*, 30*b*, 32*a* and 32*b*. A drive shaft 44 is connected to a prime mover and to rollers 30*a* and 30*b*, and drives the axially fixed drive rollers 30*a* and 30*b* in a clockwise direction as viewed in FIG. 1. As will be explained, shaft 34 supporting rollers 32*a* and 32*b* is axially biased toward the stack of envelopes 46, and forces a portion 64 of belts 26*a* and 26*b* outwardly and into contact with the last stacked envelope 50 of the stack 46**.

The movable roller sensing mechanism 20 includes the axially moveable dual rollers **32*a* and 32*b*, lever arm 36, and a biasing mechanism generally denoted 52. Lever arm 36 has a first end 54*a* and a second end 54*b*. Moveable rollers 32*a* and 32*b* are attached to the first end 54*a*, and are rotatable about shaft 34 and axially pivotal about shaft or post 38, as previously described. The second end 54*b* of arm 36 engages one end of biasing mechanism 52 via an adjustable screw 56. The distal end of the biasing mechanism 52 is secured to a nonmovable post 58. The biasing mechanism 52 extends through the space between dual stacker belts 26*a* and 26*b* (FIG. 2). Adjustable screw 56 extends toward the wand 60 of a switch mechanism comprising microswitch 62, whereby the movement of screw 56 actuates the microswitch. As viewed in FIG. 1, biasing mechanism 52 biases lever arm 36 in a counterclockwise direction around shaft 38, forcing rollers 32***a* and 32*b* and belt portion 64 outward towards envelope stack 46.

Stop member 66 provides a limit to the counterclockwise rotation of the lever arm 36 and moveable rollers 32*a* and 32*b* about shaft 38. The biasing mechanism 52 serves to urge the lever arm 36 away from the switch mechanism 62. Switch mechanism 62 is electrically coupled to a motor 69 or other prime mover that controls the movement of magazine conveyor belts 68*a* and 68*b*.

Discharge magazine 16 includes conveyor belts 68*a* and 68*b*, an adjustable compression plate 70 slidable along guide rod 72, and a document stop element 74. Each conveyor belt 68*a*, 68*b*, extends around a pair of pulleys (not shown). One of the pulleys associated with each belt 68*a*, 68*b* is driven by a suitable motor 69, which motor 69 is operatively connected to and actuated by switch 62. The conveyor belts 68*a* and 68*b* transport the envelopes in stack 46 in a direction shown by arrow 76, and are activated by the motor when the adjustable screw 56 contacts the switch mechanism 62. The stack of envelopes 46 is vertically disposed on top of and supported by belts 68*a* and 68*b*.

After the last to be stacked envelope 50, as will be explained, reaches discharge magazine 16 and the leading edge of envelope 50 abuts stop element 74, portion 64 of stacker belt 26 holds envelope 50 at an angle relative to the longitudinal direction of magazine 16. In addition, portion 78 of belt 26 extends away from discharge magazine 16 on the upstream side of rollers 32*a* and 32*b* relative to belt portion 64. As a result, a variable entrance angle 80 is formed between envelope 50 and belt portion 78. This is the entrance angle thru which envelopes 14 are transported to stack 46.

Figure 3:
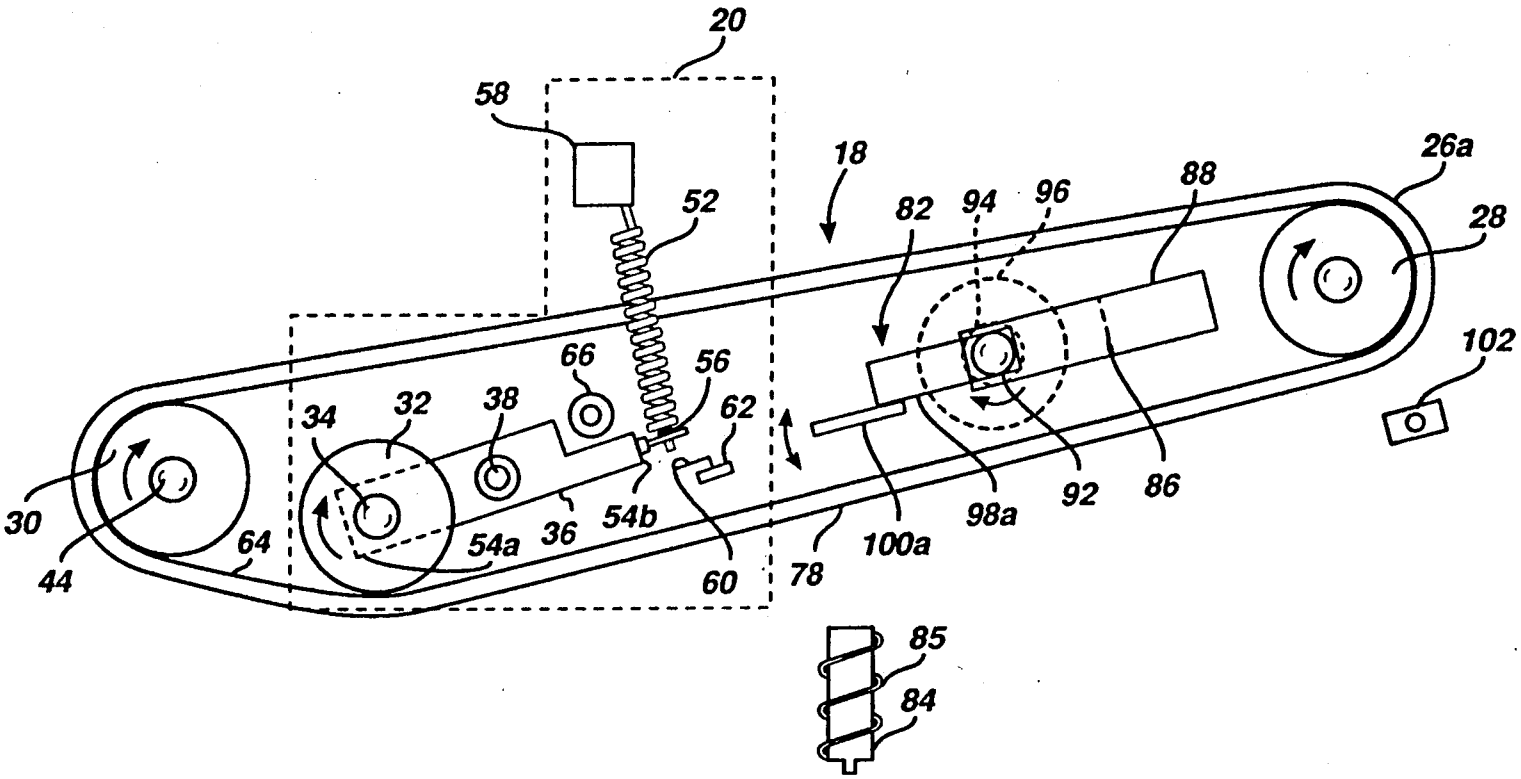
FIG. 3 is a top view schematically illustrating the kicker arm assembly of the present invention for kicking the trailing edge of each envelope away from the envelope conveying belt system and onto an auger element.

The present invention also includes a kicker arm assembly 82 (FIGS. 2, 3) for kicking the trailing edge of each envelope 14 away from belt portion 78 and onto auger 84. Auger 84 (FIGS. 1, 3) comprises a helix 85 rising slightly above the upper surface of base plate 40 which engages the bottom edge of each envelope 14 as the envelope is kicked away from belt portion 78 by kicker arm assembly 82. The auger 84 moves the trailing edge of each envelope 14 through entrance angle 80, thereby creating a space for the advancement of the next envelope into the stack 46 without causing interference with the trailing edge of the preceding envelope.

Kicker arm assembly includes a vertically disposed mounting bracket 86 fixed to base plate 40, as best seen in FIG. 2. A mounting plate 88 is fixed to and extends from the top of bracket 86, and an aperture 90 extends through an outer portion of mounting plate 88. Shaft 92 is rotatably mounted through aperture 90, and extends downward through an aperture in base plate 40. The lower end of shaft 92 is attached to the operating shaft 94 of a rotary operating solenoid 96. Shaft 94 is adapted to be rotated through a limited circular angle when solenoid 96 is actuated.

A pair of extendable arms 98*a*, 98*b* are fixed to shaft 92, and a pair of kicker arms 100*a*, 100*b* are attached to extendable arms 98*a*, 98*b* respectively. Kicker arm 100*a* is vertically located on shaft 92 such that when shaft 92 is rotated by solenoid 96 in the counterclockwise direction 16 as viewed in FIG. 3, kicker arm 100*a* extends between belts 26*a* and 26*b*. In similar fashion, kicker arm 100*b* is vertically located on shaft 92 such that when shaft 92 is rotated counterclockwise (FIG. 3) by solenoid 96, kicker arm 100*b* extends in the space between belt 26*b* and the upper surface of base plate 40. When solenoid 96 is actuated, shaft 92 rotates in a clockwise direction (FIG. 3), moving kicker arms 100*a* and 100*b* to the retracted position seen in FIG. 3. When solenoid 96 is de-activated, a spring mechanism (not shown) biases the outer ends of kicker arms 100*a* and 100*b* to extend outward beyond the vertical plane of belt portions 78 to engage the trailing edge of a moving envelope 14 as the envelope is driven towards the stack 46, thereby driving the trailing edge of the envelope through angle 80 and onto auger 84 and helix 85. The helix drives the trailing edge of the envelope in a direction away from belt portion 78, providing space for the transport of the next envelope into the stack without jamming.

A photocell sensor element 102 (FIG. 3) is mounted on base plate 40 adjacent the path traveled by each envelope 14 and just ahead of mounting bracket 86. Sensor element 102 is electrically connected through line 103 to solenoid 96. As each envelope 14 advances, sensor 102 detects the leading edge of the envelope, and sends a signal through line 103 to actuate the solenoid, rotating shaft 92 clockwise (FIG. 3), thus retracting kicker arms 100*a*, 100*b* out of the path of the advancing envelope. As the envelope 14 moves forward, sensor 102 eventually detects the trailing edge of the envelope, and sends another signal through line 103 which deactuates solenoid 96, whereby the spring mechanism rotates shaft 92 counterclockwise, extending kicker arms 100*a*, 100*b* outward beyond the vertical plane of belts 26*a*, 26*b*. As stated previously, kicker arms 100*a*, 100*b* force the trailing edge of the envelope 14 outward and onto auger 84. The vertical location of kicker arms 100*a*, 100*b* is preferably fixed such that the arms will contact regular sized envelopes as well as flat or larger sized envelopes.

In the operation of the embodiment disclosed in FIGS. 1 and 2, an envelope 14 is conveyed by the stacking belt assembly 18 along linear introductory path 12 until the leading edge of the envelope 14 contacts the most recently stacked envelope 50 after passing through the acute entrance angle 80. As the stacker belts 26*a* and 26*b* move, the leading edge of each envelope 14 is bent around bend point 104 and interposed between the most recently stacked envelope 50 and portion 64 of stacker belts 26*a* and 26*b*. The trailing edge of the envelope is displaced through the entrance angle 80 with the aid of auger 84 so that the trailing edge "fishtails" through the entrance angle. The bottom margin of the trailing edge of the envelope 14 is engaged to ride in the helical threads 85 of the rotating auger element 84 to propel the trailing edge of each envelope 14 into the stack and away from stacking belt assembly 18 to provide space for subsequently fed envelopes.

The present invention includes a unique sensing mechanism that provides a broad plane of contact with the last stacked envelope and also varies the stacker belt tension about the rollers 28*a* and 28*b*, 30*a* and 30*b*, and 32*a* and 32*b*. The moveable roller sensing mechanism 20 forms part of the stacking belt assembly 18. As more envelopes are sequentially stacked in the discharge magazine 16, a normal compressive force or pressure is developed in the stack 46 in opposition to the bias element 52 exerts on the moveable rollers 32*a* and 32*b*. This normal force causes the lever arm 36 to rotate in a clockwise direction, thereby slightly decreasing the entrance angle 80 and reducing the tension on the stacker belts 26*a* and 26*b*. When the force applied by the stack 46 to the movable rollers 32*a* and 32*b* exceeds the force applied to the moveable rollers by the biasing mechanism 52, the adjustable screw 56 engages microswitch 62 and activates the motor driving magazine conveyor belts 68*a* and 68*b*.

The conveyor belts 68*a* and 68*b* then convey the envelopes away from the stacker belts 26*a* and 26*b* in the direction of arrow 76, thereby relieving the pressure force previously exerted on the movable rollers 32*a* and 32*b* and allowing the lever arm 36 to rotate in the counterclockwise direction under the bias of mechanism 52. This causes the adjustable screw 56 to disengage from switch mechanism 62 which de-activates the motor connected to magazine conveyor belts 68*a* and 68*b*. The envelopes in the front part of stack 46 fan out as pressure is relieved, allowing additional envelopes to be sequentially fed into the stack without interference from the trailing edge of previously stacked envelopes.

Undesirable variations in pressure sensing by the movable roller sensing mechanism 20 due to slack in the stacker belts 26*a* and 26*b* is further reduced by the direction of movement of the stacker belts 26*a* and 26*b*. The drive roller 30 rotates clockwise as viewed in FIG. 1, and pulls the stacker belts 26 tightly over movable rollers 32*a* and 32*b* while "pushing" the stacker belts 26*a* and 26*b* toward idler rollers 28*a* and 28*b*. Therefore, any slack in the stacker belts 26*a* and 26*b* is developed in the top run of the triangular path between drive rollers 30*a* and 30*b* and idler rollers 28*a* and 28*b*. Belts 26*a* and 26*b* remain taught as they travel from idler rollers 28*a* and 28*b* to axially moveable rollers 32*a* and 32*b*, and from moveable idler rollers 32*a* and 32*b* to drive rollers 30*a* and 30*b*. This taughtness of belts 26*a* and 26*b* adjacent rollers 32*a* and 32*b* enhances the accuracy of roller sensing mechanism 20.

As illustrated in FIG. 2, the lever arm 36 is vertically situated adjacent the gap between stacker belts 26*a* and 26*b*. Shaft 38 and non-moveable stop member or post 66 are fixedly secured to base plate 40 via attachment bolts 110, 112.

The plane of contact between the movable roller sensing mechanism 20 and envelopes 14 comprises the broad surfaces of the dual stacker belts 26*a* and 26*b*, rather than a separate rod or arm type sensing lever with a small plane of contact, as found in the prior art. The stacker belts 26*a* and 26*b* of the present invention are used both to transport envelopes directly into the stack 46 and also to form a broad pressure sensing surface which senses stack pressure accurately regardless of the tilt of the forward envelopes.

Kicker arm assembly 82 cooperates with the stacking belt assembly 18 and the roller sensing mechanism 20 to move the trailing edge of each envelope away from the path of subsequently fed envelopes as each prior envelope reaches the stack 46. As described previously, kicker arm assembly operates to kick the trailing edge of each envelope as it reaches the stack in a direction toward the stack and onto auger 84, and out of the primary path of envelope travel, as defined by introductory conveying path 12 and belt portion 78 of stacking belt assembly 18. The trailing edge of each envelope is therefore removed from possible interference with the leading edge of an incoming envelope. As the number of unimpeded envelopes entering the stack increases, the normal force applied by the stack of envelopes against the roller sensing mechanism 20 increases to the point where the compressed stack of envelopes presents another impediment to rapid introduction of envelopes into the stack. As explained, when the normal force reaches a predetermined limit, the magazine conveyor belts 68*a* and 68*b* are driven to relieve the stack pressure adjacent the stacking belt assembly 18.

As appreciated by those having ordinary skill in the art, a single belt 26 configuration may also be suitable, provided the width of the belt 26 that forms the contact surface is proportionally wide enough to contract a substantial portion of each envelope.

Figure 4:
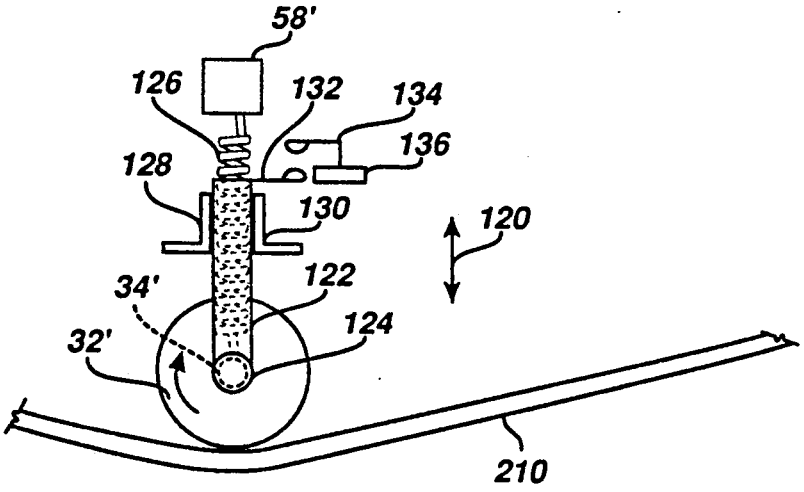
FIG. 4 is an additional embodiment of a moveable sensor mechanism constructed in accordance with the invention.

FIG. 4 illustrates an alternative embodiment of the roller sensing mechanism of the present invention, comprising a substantially linearly moving sensor element. A spring loaded sensing roller 20' replaces the roller sensing mechanism 20 shown in FIGS. 1, 2 and 3. As illustrated in FIG. 4, linear displacement occurs in the horizontal direction, as indicated by arrow 120, as opposed to the rotational displacement of the moveable sensing mechanism 20 of FIG. 1. A hollow cylindrical member 122 is fixedly mounted to a vertically extending sleeve 124 through which rotatable shaft 34 extends. Moveable roller 32 is rotatably mounted on shaft 34. The cylindrical member 122 houses biasing element 126, which is substantially restricted to linear movement by guide plates 128 and 130. A lever 132 is attached to an end of sleeve 124, and is adapted to contact and move wand 134 of microswitch 136.

The operation of the alternate embodiment of FIG. 4 is similar to the operation of the embodiment of FIG. 1. As stack pressure increases, moveable roller 32' moves horizontally in the direction of the application of stack pressure, driving shaft 34', sleeve 124, hollow cylindrical member 122 and lever 132 in the same direction. When the stack pressure has reached a predetermined maximum limit, lever 132 comes into contact with wand 134, activating microswitch 136 and moving magazine conveyor belts 68*a* and 68*b* in a direction away from stacking belt assembly 18. Although a spring is shown as a representation of biasing element 126, other suitable biasing elements can be substituted therefor.

While the invention has been particularly shown and described with reference to the preferred embodiments thereof, it will be understood by those having ordinary skill in the art that numerous variations in form and detail may be made without departing from the spirit and scope of the invention, as set forth in the following claims.

What I claim is:

1. Apparatus for stacking a plurality of flat articles on edge, said apparatus comprising:

a discharge magazine for sequentially receiving and stacking said flat articles in a stack;

said discharge magazine including moveable discharge support means adapted to support said stack of articles on edge and moveable compression plate means to maintain said articles on edge;

drive means for controllably moving said discharge support means;

a stacker section adjacent said discharge magazine for transporting articles sequentially into said stack, said stacker section comprising stacker belt means extending around a plurality of roller means;

the last of said articles in said stack abutting against said stacker belt means adjacent one of said roller means to apply a compressive force developed by said stack of flat articles and said compression plate to said one roller means;

said one roller means movably mounted to said stacker section with respect to at least another of said plurality of roller means, for movement responsive to increases and decreases in said compressive force;

actuator means operatively connected to and responsive to movement of said one roller means and connected to said drive means for activating said drive means and said discharge support means to transport said stack of flat articles away from said stacker section when said compressive force reaches a predetermined maximum value.

2. The apparatus of claim 1 wherein said moveable discharge support means comprises moveable discharge belts adapted to support said stack of articles on edge.

3. The apparatus of claim 1 wherein said one roller means is pivotably moveable, whereby said one roller means rotates about an axis, said axis being moveable in a non-linear path in response to said compressive force.

4. The apparatus of claim 3 wherein said one roller means is rotatably mounted to one end of a lever arm;

said lever arm pivotably mounted to said stacker section;

a second end of said lever arm adapted to alternatively engage said actuator means to activate and de-activate said drive means; and resilient force means connected to said lever arm to bias said one roller means into engagement with said last of said articles in said stack.

5. The apparatus of claim 1 wherein said stacker belt means provides a substantially vertical plane of contact between said last of said articles in said stack and said stacker belt means in a region of said stacker belt means adjacent said one roller means.

6. The apparatus of claim 1 further comprising an introductory feed belt means adjacent said stacker belt means to form a continuous belt path for directing said flat articles in said stack.

7. Apparatus for stacking a plurality of flat articles on edge, said apparatus comprising:

a discharge magazine for sequentially receiving and stacking said flat articles in a stack;

said discharge magazine including moveable discharge support means adapted to support said stack of articles on edge and moveable compression plate means to maintain said articles on edge;

drive means for controllably moving said discharge support means;

a stacker section adjacent said discharge magazine for transporting articles sequentially into said stack, said stacker section comprising stacker belt means extending around a plurality of roller means;

the last of said articles in said stack abutting against said stacker belt means adjacent one of said roller means to apply a compressive force developed by said stack of flat articles and said compression plate to said one roller means;

said one roller means movably mounted for movement responsive to increases and decreases in said compressive force;

actuator means operatively connected to and responsive to movement of said one roller means and connected to said drive means for activating said drive means and said discharge support means to transport said stack of flat articles away from said stacker section when said compressive force reaches a predetermined maximum value wherein; said one roller means is rotatable about an axis, said axis being linearly moveable relative to said plurality of articles on edge in response to said compressive force.

8. The apparatus of claim 7 wherein said one roller means is rotatably mounted about an axially extending shaft; said shaft attached to a support member mounted for limited reciprocal linear movement relative to said apparatus;

said support member biased by a resilient element in a direction toward said stack of articles; and said actuator means activated and de-activated by movement of said support member.

9. The apparatus of claim 8 wherein said support member comprises a hollow portion, said resilient element extending into said hollow portion of said support member.

10. An apparatus for stacking a plurality of flat articles on edge, said apparatus comprising:

a discharge magazine for sequentially receiving and stacking said flat articles in a stack;

said discharge magazine comprising moveable discharge belt means adapted to support said stack of articles on edge in said discharge magazine, and a moveable compression plate to maintain said articles on edge in said discharge magazine;

said moveable discharge belt means driven by drive means connected to said discharge belt means for moving said discharge belt means over a surface of said discharge magazine;

a stacker section adjacent said discharge magazine for transporting documents sequentially into said stack, said stacker section comprising a pair of stacker belt means extending in a vertical plane around a plurality of roller means;

one of said plurality of roller means disposed adjacent said stack of articles such that the last of the articles in said stack abuts against said stacker belt means adjacent said one roller means to provide a compressive force developed by said stack against said one roller means;

said one roller means moveably mounted to said stacker section with respect to at least another of said plurality of roller means, for rotational movement on one portion of a lever arm, said lever arm pivotally mounted, to said stacker section a second portion of said lever arm connected to a resilient element to bias said one roller means towards said stack of articles;

said lever arm pivotally moveable responsive to said compressive force being applied to said one roller means, and switch means electrically connected to said drive means to activate and de-activate said drive means, said switch means operated by movement of said lever arm to drive said discharge belt means in a direction away from said stacker belt means when the compressive force applied by said stack of articles against said one roller means reaches a predetermined value and pivots said lever over a predetermined distance.

11. An apparatus for stacking a plurality of flat articles on edge, said apparatus comprising:

a discharge magazine for sequentially receiving and stacking said flat articles in a stack;

said discharge magazine comprising moveable discharge belt means adapted to support said stack of articles on edge in said discharge magazine, and a moveable compression plate to maintain said articles on edge in said discharge magazine;

said moveable discharge belt means driven by drive means connected to said discharge belt means for moving said discharge belt means over a surface of said discharge magazine;

a stacker section adjacent said discharge magazine for transporting documents sequentially into said stack, said stacker section comprising a pair of stacker belt means extending in a vertical plane around a plurality of roller means;

one of said roller means disposed adjacent said stack of articles such that the last of the articles in said stack abuts against said stacker belt means adjacent said one roller means to provide a compressive force developed by said stack against said one roller means;

said one roller means having an axis adapted for linear movement;

said axis comprising a shaft mounted to a support member, said support member and said shaft being linearly moveable towards and away from said stack of articles;

a resilient element biasing said support element and said stacker belt means adjacent said one roller means into contact with the last of said articles in said stack;

said one roller means and said support element being linearly moveable responsive to said compressive force;

switch means electrically connected to said drive means to activate and de-activate said drive means, said switch means operated by movement of said support element to drive said discharge belt means in a direction away from said stacker belt means when the compressive force applied by said stack of articles against said one roller means reaches a predetermined value and moves said support element over a predetermined distance.

12. An apparatus for transporting a plurality of flat articles on edge along a path and into a stack, and providing space in the stack to permit subsequent articles to be sequentially fed into the stack without jamming, comprising:

a discharge magazine for sequentially receiving and stacking said flat articles in said stack;

said discharge magazine including moveable discharge support means adapted to support said stack of articles on edge, and moveable compression plate means to maintain said articles on edge whereby a compression force is developed in said stack;

drive means for controllably moving said discharge support means;

a stacker section adjacent said discharge magazine for transporting articles sequentially into said stack;

said stacker section including stack force sensing means for sensing when the compression force of the stack reaches a predetermined value as additional articles are transported to the stack;

said stack force sensing means operatively connected to said drive means to activate said drive means to move said discharge support means and reduce the compression force of the stack against said stacker section when said compression force reaches a predetermined value, and to loosen the compression force between adjacent articles in the stack to provide space for the entry of additional articles into the stack;

auger means engaging a lower margin of a trailing edge of each article entering the stack to drive the trailing edge away from the stacker means and direct said trailing edge out of the path of subsequent articles being transported into said stack; and kicker means disposed adjacent the path of said articles and normally held in a first position into the path of said articles to engage the trailing edge of a last article in said stack, said kicker means operably moveable to a second position out of the path of said articles, said kicker means when in said first position applying a force to the trailing edge of each article to drive said trailing edge into contact with said auger means;

said sensor means disposed adjacent said path to sense a leading edge of each article entering the stack and move said kicker means to said second position in response to said sensing of said leading edge;

said sensor means further adapted to sense the trailing edge of each said article entering the stack and move said kicker means to said first position from said second position in response to said sensing of said trailing edge.

13. A method for controlling the compressive force in a stack of sheet-like articles transported sequentially into the stack by an article transporting means having a transport belt extended about a plurality of roller means, one of said plurality of roller means being moveable with respect to another of said plurality of roller means, the method comprising the steps of:

transporting the sheet-like articles sequentially into the stack such that the last article transported into the stack bears against said one moveable roller means and a compressive force is developed in said stack which compressive force results in movement of said moveable roller means of said transporting means;

moving said one moveable roller means, in response to said compressive force, with respect to another of said plurality of roller means;

sensing the movement of said one moveable roller means to a predetermined maximum amount;

moving said stack in a direction away from said article transporting means in response to movement of said moveable roller means said maximum amount to reduce the compressive force in said stack.

14. The method of claim 13 including the additional step of:

applying a force to the trailing edge of each of said articles to move said trailing edge onto a moveable element which drives said trailing edge out of the path of subsequent articles being transported into said stack.

* * * * *